US008149123B2

(12) United States Patent
Ichiboshi et al.

(10) Patent No.: US 8,149,123 B2
(45) Date of Patent: Apr. 3, 2012

(54) WIRELESS COMMUNICATIONS APPARATUS, PROCESSING APPARATUS, AND WIRELESS COMMUNICATIONS SYSTEM

(75) Inventors: Akira Ichiboshi, Ebina (JP); Tsutomu Ishii, Ebina (JP); Yasunori Saito, Ashigarakami-gun (JP); Shigehiko Sasaki, Ebina (JP); Kyotaro Tomoda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 329 days.

(21) Appl. No.: 12/402,033

(22) Filed: Mar. 11, 2009

(65) Prior Publication Data

US 2010/0073136 A1 Mar. 25, 2010

(30) Foreign Application Priority Data

Sep. 22, 2008 (JP) ..... 2008-242822

(51) Int. Cl.
*G08B 13/14* (2006.01)

(52) U.S. Cl. ..... 340/572.8; 340/572.1; 235/380; 455/90.3

(58) Field of Classification Search ..... 340/572.8, 340/572.1, 10.1, 10.51; 235/380, 492; 455/90.3
See application file for complete search history.

(56) References Cited

U.S. PATENT DOCUMENTS

| | | | | |
|---|---|---|---|---|
| 7,762,470 | B2 * | 7/2010 | Finn et al. | 235/492 |
| 7,792,927 | B2 * | 9/2010 | Umehara et al. | 709/219 |
| 2007/0182565 | A1 * | 8/2007 | Lee et al. | 340/572.8 |
| 2008/0012714 | A1 * | 1/2008 | Furutani | 340/572.8 |
| 2009/0065582 | A1 * | 3/2009 | Kon et al. | 235/439 |

FOREIGN PATENT DOCUMENTS

| | | |
|---|---|---|
| JP | A-11-282979 | 10/1999 |
| JP | A-2000-30007 | 1/2000 |
| JP | A-2000-285207 | 10/2000 |
| JP | A-2007-79810 | 3/2007 |
| JP | A-2007-264980 | 10/2007 |
| JP | A-2007-288314 | 11/2007 |

OTHER PUBLICATIONS

Japanese Office Action dated Jul. 6, 2010 issued in Japanese Patent Application No. 20082428822 (with translation).

* cited by examiner

*Primary Examiner* — Brent Swarthout
*Assistant Examiner* — Hongmin Fan
(74) *Attorney, Agent, or Firm* — Oliff & Berridge, PLC

(57) ABSTRACT

A wireless communications apparatus includes: a second communications unit that uses electromagnetic waves to perform wireless communications with a recording medium having a first communications unit that stores information; and a housing that houses a portion of the recording medium, the portion including the first communications unit, wherein the second communications unit is provided at a position that faces the first communications unit housed in the housing; and the housing has a first electromagnetic wave suppressing member that suppresses radiation of electromagnetic waves from inside to outside, and suppresses radiation of electromagnetic waves from the second communications unit in a direction other than towards the first communications unit of the recording medium in a state housed in the housing.

17 Claims, 3 Drawing Sheets

WIRELESS COMMUNICATIONS APPARATUS, PROCESSING APPARATUS, AND WIRELESS COMMUNICATIONS SYSTEM

CROSS-REFERENCE TO RELATED APPLICATIONS

This application claims priority under 35 USC 119 from a Japanese patent application No. 2008-242822 filed on Sep. 22, 2008.

BACKGROUND

1. Technical Field

The present invention relates to a wireless communications apparatus, a processing apparatus, and a wireless communications system.

2. Related Art

A semiconductor chip (referred to below as a "wireless tag") that performs wireless communications is used in various articles. One feature of the wireless tag is that because the wireless tag is capable of performing communications even without contact, the wireless tag can perform communications at any position within a range where wireless communications is possible.

SUMMARY

It is an object of the present invention to suppress wireless communications from being performed with an unintended wireless tag.

According to an aspect of the invention, a wireless communications apparatus, comprising: a second communications unit that uses electromagnetic waves to perform wireless communications with a recording medium having a first communications unit that stores information; and a housing that houses a portion of the recording medium, the portion including the first communications unit, wherein the second communications unit is provided at a position that faces the first communications unit housed in the housing; and the housing has a first electromagnetic wave suppressing member that suppresses radiation of electromagnetic waves from inside to outside, and suppresses radiation of electromagnetic waves from the second communications unit in a direction other than towards the first communications unit of the recording medium in a state housed in the housing.

BRIEF DESCRIPTION OF THE DRAWINGS

Exemplary embodiment(s) of the present invention will be described in detail based on the following figures, wherein.

DETAILED DESCRIPTION

1. Exemplary Embodiment

Figure 1:
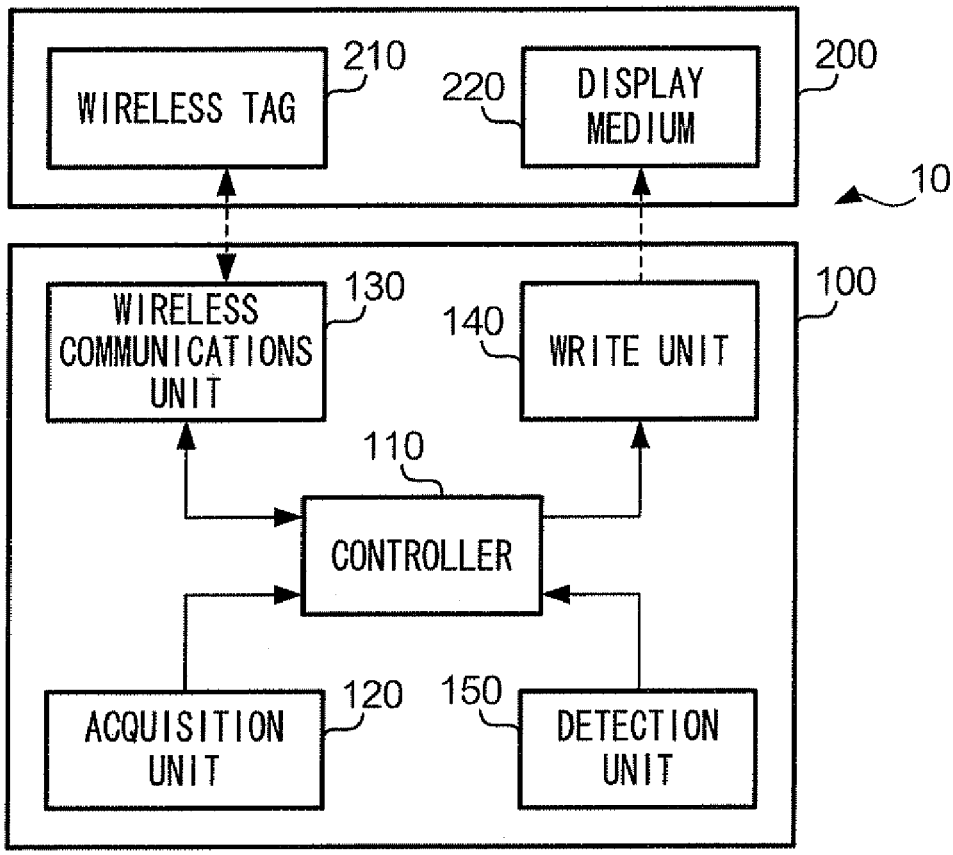
FIG. 1 is a block diagram that shows the configuration of a wireless communications system.

FIG. 1 is a block diagram that shows the configuration of a wireless communications system in accordance with one exemplary embodiment of the invention. In FIG. 1, a wireless communications system 10 of this exemplary embodiment includes a wireless communications apparatus 100 and a recording medium 200. In this exemplary embodiment, the recording medium 200 is so-called electronic paper. Therefore, the recording medium 200 includes a display medium 220 in addition to a wireless tag 210. Also, in this exemplary embodiment, the wireless communications apparatus 100 has a function to perform wireless communications with the wireless tag 210 of the recording medium 200, and a function to rewrite the display medium 220.

The wireless communications apparatus 100 includes a controller 110, an acquisition unit 120, a wireless communications unit 130, a write unit 140, and a detection unit 150. The controller 110 includes a processor such as a CPU (Central Processing Unit) and a memory. The controller 110 controls operation of the wireless communications apparatus 100 by executing a program that has been stored in advance. The acquisition unit 120 acquires information used for operation of the wireless communications apparatus 100. The acquisition unit 120 may acquire information from a memory such as a flash memory, or may acquire information from an external network such as the Internet. Information to be displayed on the display medium 220 is also included in the information that the acquisition unit 120 acquires. Below, this is referred to as "display information".

The wireless communications unit 130 includes an antenna 131 described below, and performs wireless communications with the wireless tag 210 of the recording medium 200. The wireless communications unit 130 is able to send or receive information, but in this exemplary embodiment, receives information by reading information from the wireless tag 210. In this exemplary embodiment, the information that the wireless communications unit 130 receives is identification information that identifies respective recording mediums 200. However, the information that the wireless communications unit 130 receives is not limited thereto, and for example, may be information that identifies display information that is displayed on the display medium 220 of the recording medium 200.

The write unit 140 controls the display medium, for example, to display display information on the display medium 220 of the recording medium 200, or to erase display information that has been displayed on the display medium 220. That is, the write unit 140 writes or rewrites the display of the display medium 220. The write unit 140 has a configuration according to the display method of the display medium 220, but in this exemplary embodiment, is configured to irradiate light and supply voltage to the display medium 220. The detection unit 150 includes a sensor 151 that detects that the recording medium 200 has been installed in the wireless communications apparatus 100 in a predetermined manner. The controller 110 determines whether the recording medium 200 has been installed in the wireless communications apparatus 100 based on the detection results of the detection unit 150, and when determined that the recording medium 200 has been installed, causes the write unit 140 to perform rewriting.

As described above, the recording medium 200 includes the wireless tag 210 and the display medium 220. The wireless tag 210 is an example of a first communications unit, and includes a CPU, an EEPROM (Electrically Erasable and Programmable Read-Only Memory), an antenna, and the like. The wireless tag 210 performs wireless communications with the wireless communications unit 130 of the wireless communications apparatus 100. The wireless tag 210 of this exemplary embodiment stores identification information in the EEPROM. Note that the wireless tag 210 may also store other information, and may rewrite stored information. Also, operation of the wireless tag 210 may be performed using electrical power extracted from electromagnetic waves emitted from the antenna 131, or power may be supplied from a battery provided in the recording medium 200. The display medium 220 includes a display area where information is displayed in a rewritable manner. The display medium 220 of this exemplary embodiment displays information using cholesteric liquid crystal display elements. However, the display medium in the invention is not limited to this, and for example, may be a display medium that employs a leuco dye.

Figure 2:
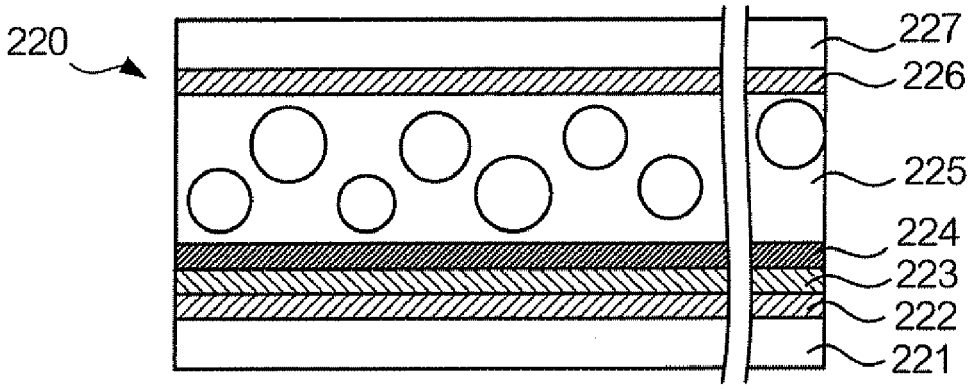
FIG. 2 is a cross-sectional view that shows the configuration of a display medium.

FIG. 2 is a cross-sectional view of the display medium 220, showing a configuration of the display medium 220. As shown in FIG. 2, the display medium 220 has film substrates 221 and 227, transparent electrodes 222 and 226, a photoconductive layer 223, a color layer 224, and a display element layer 225. Note that the optical writing-type display medium of this exemplary embodiment is a display medium that performs monochrome display. The film substrates 221 and 227 are layers provided in order to protect the surface of the display medium 220, and are formed from PET (Polyethylene Terephthalate), for example. The film substrate 221 is a face on a side where light is irradiated, and the film substrate 227 is a face on a side where a user can observe information that has been written. The transparent electrodes 222 and 226 are electrodes that are electrically connected to the write unit 140 of the wireless communications apparatus 100, and for example, are layers formed from ITO (Indium Tin Oxide). When voltage is applied to the transparent electrodes 222 and 226, a potential difference arises between them. The photoconductive layer 223 is a layer formed from a conductor (i.e., a photoconductor) that causes the conductivity of the photoconductive layer 223 to differ according to the power of irradiated light. For example, an organic photoconductor is used as the photoconductive layer 223.

The color layer 224 is a layer that is observed when the display element layer 225 transmits light, and has a predetermined color (black in this exemplary embodiment). The display element layer 225 is a layer that includes a display element that causes the light reflection state to differ according to the voltage that is applied. In the display element layer 225 of this exemplary embodiment, microcapsule cholesteric liquid crystal display elements have been dispersed in a binder resin. The orientation state of the cholesteric liquid crystal display elements can be a planar orientation or a focal conic orientation. When the cholesteric liquid crystal display elements are in a planar orientation, light is reflected (Bragg reflection) and a predetermined color (white in this exemplary embodiment) is shown, and when the cholesteric liquid crystal display elements are in a focal conic orientation, light is transmitted and the color of the color layer 224 is shown. Which of these orientations the cholesteric liquid crystal display elements are in is determined by the potential difference that occurs in the cholesteric liquid crystal display elements. The potential difference that occurs in the cholesteric liquid crystal display elements changes according to the conductivity of the opposing photoconductive layer 223.

Figure 3A:
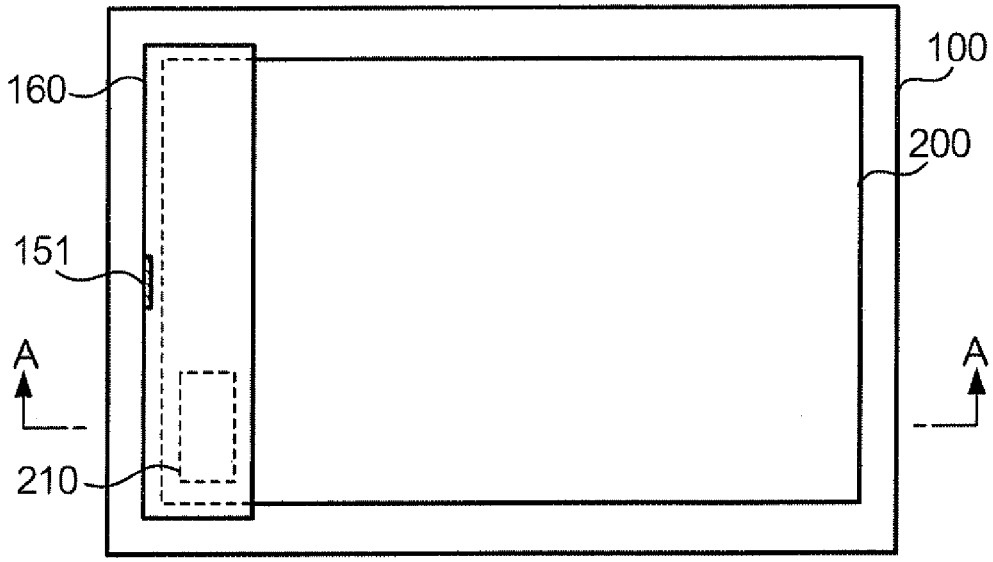
FIGS. 3A and 3B show a state in which a recording medium is installed in a wireless communications apparatus.
Figure 3B:
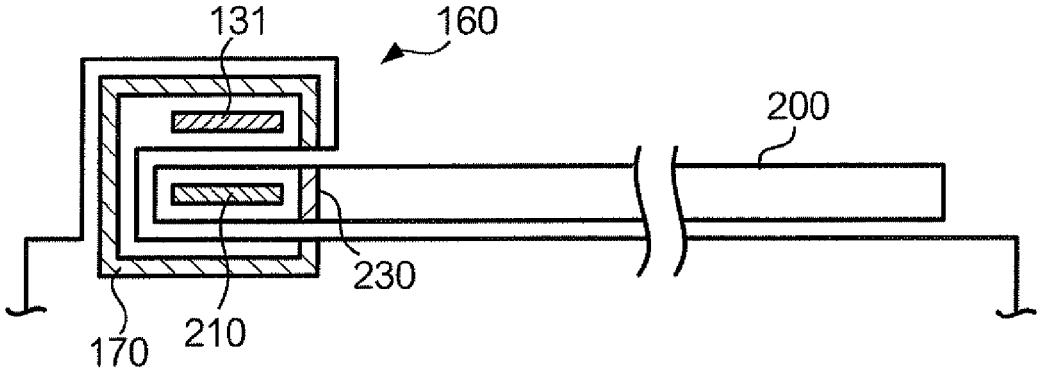

FIGS. 3A and 3B show a state in which the recording medium 220 is installed in the wireless communications apparatus 100. As shown in FIG. 3A, the wireless communications apparatus 100 has a structure that houses at least a part (the broken line portion) of the recording medium 200. The portion that houses the recording medium 200 of the wireless communications apparatus 100 is referred to below as a "housing 160". In this exemplary embodiment, the housing 160 is provided so as to cover a part of the recording medium 200, but the housing 160 may also have a shape that covers all of the recording medium 200. In this exemplary embodiment, a state in which the recording medium 200 is installed in the wireless communications apparatus 100 refers to a state in which the recording medium 200 is housed in the housing 160.

The portion that is housed in the housing 160 is a portion of the recording medium 200 that includes the wireless tag 210. The portion that includes the wireless tag 210, for example, is the portion indicated by the broken line in FIG. 3A, but this portion may also be located at another position. FIG. 3B is a cross-sectional view of relevant portions of the wireless communications apparatus 100 and the recording medium 200 when a cross-section has been taken along line A-A in FIG. 3A, i.e., when taking a cross-section of the portion that includes the wireless tag 210. As shown in FIG. 3B, the antenna 131 is an example of a second communications uni and is provided at a position facing the wireless tag 210 in the housing 160. The antenna 131, for example, is a flat coil. Also, an electromagnetic wave absorbing member 170 is provided in the housing 160 so as to cover the wireless tag 210 and the antenna 131. Likewise, an electromagnetic wave absorbing member 230 is provided in the recording medium 200 so as to cover the wireless tag 210 and the antenna 131 in combination with the electromagnetic wave absorbing member 170 when housed in the housing 160.

The electromagnetic wave absorbing members 170 and 230 are examples of an electromagnetic wave suppressing member that suppresses radiation of electromagnetic waves from inside to outside. Here, "inside" refers to the side where electromagnetic waves occur, viewed from the electromagnetic wave absorbing members 170 and 230. The electromagnetic wave absorbing members 170 and 230, by absorbing electromagnetic waves that are radiated from the antenna 131, prevent these electromagnetic waves from being radiated to the outside, i.e. prevent these electromagnetic waves from being irradiated from the portion covered by the electromagnetic wave absorbing members 170 and 230 to the outside. Dielectric absorbent material such as carbon rubber, magnetic absorbent material such as ferrite, or the like is used for the electromagnetic wave absorbing members 170 and 230.

The electromagnetic wave absorbing member 170 is at least provided on the upper face (the face on the side not facing the wireless tag 210) of the antenna 131. It is comparatively difficult for the antenna 131 to radiate electromagnetic waves in the lateral direction in FIG. 3B, i.e., in the direction perpendicular to the direction facing the wireless tag 210, but in order to further suppress radiation of electromagnetic waves to the outside, the electromagnetic wave absorbing member 170 may be provided so as to also absorb electromagnetic waves in this lateral direction. The electromagnetic wave absorbing member 230 is provided for the same purpose.

Also, in order to prevent electromagnetic waves from being radiated to the outside, it is desirable that the gap between the electromagnetic wave absorbing members 170 and 230 is made small. For example, the housing 160 may have a shape such that excess space does not occur between the housing 160 and the recording medium 200.

The sensor 151 detects whether the recording medium 200 is housed in the housing 160. The sensor 151, for example, is a sensor that detects contact of the recording medium 200, and detects that the recording medium 200 has been inserted into the housing 160. Note that the sensor 151 may also be a sensor that optically detects the recording medium 200.

The configuration of the wireless communications system 10 of this exemplary embodiment is as described above.

Based on this configuration, a user installs the recording medium 200 in the wireless communications apparatus 100 when rewriting of the recording medium 200 becomes necessary. When the wireless communications apparatus 100 detects that the recording medium 200 has been installed using the detection unit 150, the wireless communications apparatus 100 performs rewriting of the recording medium 200.

When performing rewriting of the recording medium 200, the wireless communications apparatus 100 acquires identification information of the installed recording medium 200 via the wireless communications unit 130, and stores the acquired identification information. When the wireless communications apparatus 100 performs rewriting of the recording medium 200, information corresponding to the rewriting results and identification information are stored in association with each other. Here, information corresponding to the rewriting results is, for example, information (such as a file name) that identifies display information after rewriting. Also, when the wireless communications apparatus 100 has erased the recording medium 200, information indicating that display information was erased and identification information may be stored in association with each other.

Figure 4:
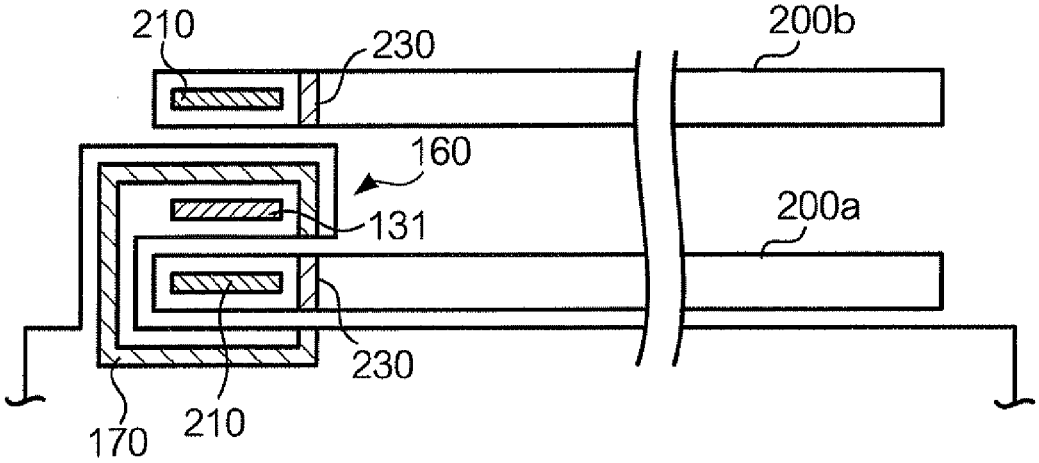
FIG. 4 shows an example of how the wireless communications apparatus prevents emission of electromagnetic waves.

According to the wireless communications system 10 of this exemplary embodiment, wireless communications with a wireless tag other than the wireless tag 210 of the recording medium 200 that has been installed in the wireless communications apparatus 100 is avoided. For example, even when, as shown in FIG. 4, a recording medium 200*a* that has been installed and another recording medium 200*b* exist near the wireless communications apparatus 100, and the wireless tags 210 of both the recording medium 200*a* and the recording medium 200*b* are in a range where wireless communications are possible with the antenna 131, because the wireless tag 210 of the recording medium 200*b* is outside of the electromagnetic wave absorbing member 170, reception of electromagnetic waves radiated from the antenna 131 by the wireless tag 210 of the recording medium 200*b* is avoided. On the other hand, when the electromagnetic wave absorbing member 170 is not present, the antenna 131 is capable of communicating with the wireless tags 210 of both the recording medium 200*a* and the recording medium 200*b*.

Accordingly, with the wireless communications system 10 of this exemplary embodiment, a mismatch between the target of wireless communications and the target of rewrite processing, such as in which the recording medium whose display was rewritten is the recording medium 200*a* but the recording medium with which wireless communications was performed is the recording medium 200*b*, is avoided, so the correctness of the association of information according to rewriting results and identification information is further guaranteed. Thus, with the wireless communications system 10 of this exemplary embodiment, mistaken communications or disguising behavior in which, for example, a recording medium to which rewriting was not performed is deceptively presented as a recording medium to which rewriting was performed is suppressed.

2. Further Embodiments

The exemplary embodiment described above is merely an example of the invention. In the invention, the following modified examples are applicable, for example. Also, the above exemplary embodiment and the below modified examples may be applied in combination.

(1) Modification 1

The above write unit 140 performs processing to rewrite to the recording medium 200, and is one example of a processing unit. However, in the invention, processing to rewrite to a different article than the recording medium 200 may be performed, and in this case, the processing unit may be changed according to that article. For example, the processing unit may optically read an image displayed on an article, a barcode, or the like, or the processing unit may perform a deformation process or the like on the article.

Note that the processing unit may be realized with an external apparatus other than the wireless communications apparatus.

(2) Modification 2

The wireless communications apparatus may perform wireless communications with multiple predetermined recording mediums; the number of recording mediums is not limited to one. In a case where the wireless communications apparatus performs wireless communications with multiple recording mediums, any configuration may be adopted as long as it is possible to distinguish between those multiple recording mediums and another recording medium.

Figure 5:
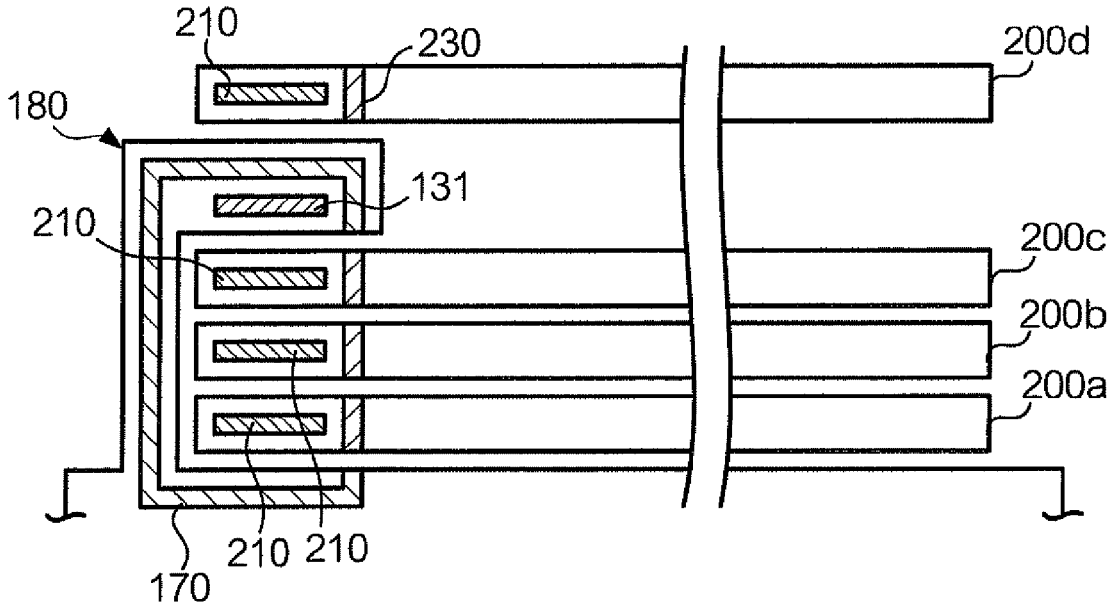
FIG. 5 shows a modified example of a housing.

FIG. 5 shows a modified example of a housing. In a housing 180 shown in FIG. 5, three stacked recording mediums 200 (200*a*, 200*b*, and 200*c*) can be housed, but the housing 180 has a shape with a space of a thickness such that four or more stacked recording mediums 200 cannot be housed. In this case, a recording medium 200*d* shown in FIG. 5 cannot perform wireless communications with the antenna 131. Also, each of the recording mediums 200 have the same shape, and have a predetermined thickness. Here, "thickness" of the recording mediums 200 refers to the size in the direction facing the antenna 131 when housed in the housing 180. Also, the "thickness" of the space of the housing 180 refers to the size in the same direction.

(3) Modification 3

Figure 6A:
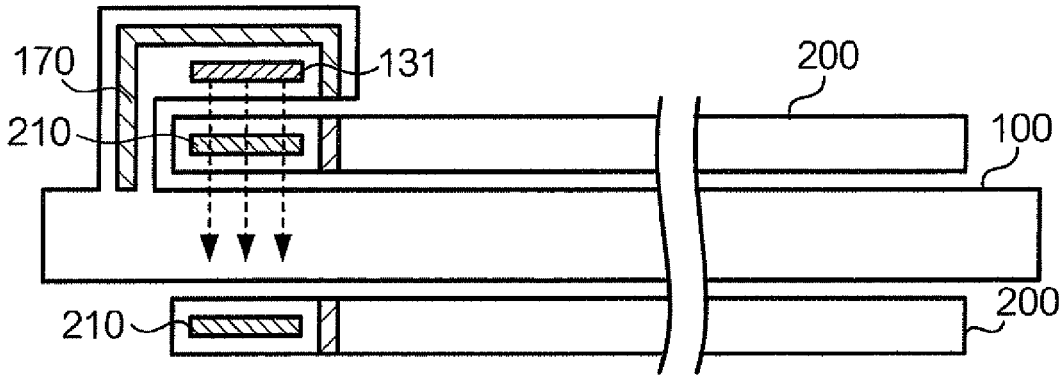
FIGS. 6A and 6B show a modified example of the wireless communications apparatus.

In the configuration shown in FIG. 3B, there may be instances when it is not necessary to provide the electromagnetic wave absorbing member 170 on the lower face (the face on the side not facing the antenna 131) of the wireless tag 210. For example, as shown in FIG. 6A, when the wireless communications apparatus 100 has adequate thickness (thickness that exceeds the range in which the antenna 131 is capable of communications) in the direction of the lower face, even if the electromagnetic wave absorbing member 170 is not provided on the lower face of the wireless tag 210, there is no risk that mistaken communications will be performed with a recording medium 200 that has been placed below the wireless communications apparatus 100. Thus, in such a case, a configuration may be adopted in which the electromagnetic wave absorbing member 170 suppresses only electromagnetic waves radiated from the antenna 131 in a direction other than towards the wireless tag 210.

Figure 6B:
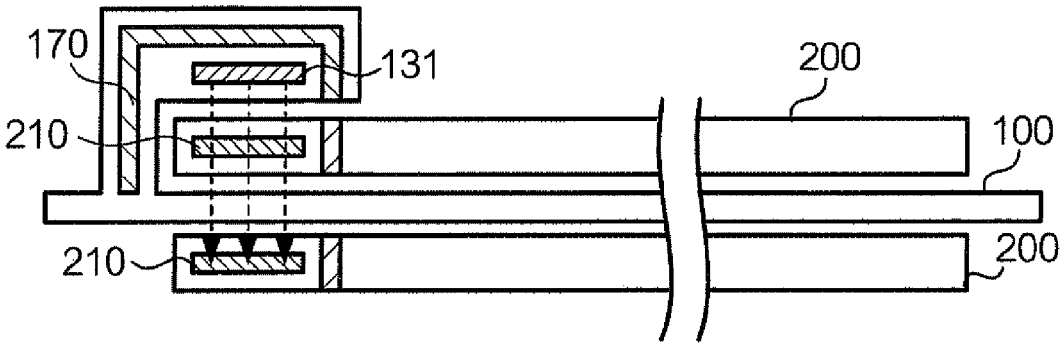

On the other hand, as shown in FIG. 6B, when the wireless communications apparatus 100 does not have adequate thickness in the direction of the lower face, in order to avoid mistaken communications with a recording medium 200 that has been placed below the wireless communications apparatus 100, it is desirable to provide the electromagnetic wave absorbing member 170 on the lower face of the wireless tag 210. Also, this electromagnetic wave absorbing member may be provided in the wireless communications apparatus 100, or may be provided on the face on the side of the recording medium 200 that does not face the antenna 131.

What is claimed is:

1. A wireless communications apparatus, comprising:

a second communications unit that uses electromagnetic waves to perform wireless communications with a recording medium having a first communications unit and a display, the first communications unit storing information;

a write unit configured to write image data to the display; and a housing that houses a portion of the recording medium, the portion including the first communications unit, wherein the second communications unit is provided at a position that faces the first communications unit housed in the housing;

the housing has a first electromagnetic wave absorbing member that absorbs radiation of electromagnetic waves from inside to outside, and absorbs radiation of electromagnetic waves from the second communications unit in a direction other than towards the first communications unit of the recording medium in a state housed in the housing;

the recording medium has a second electromagnetic wave absorbing member, the second electromagnetic wave absorbing member disposed between the first communications unit and the display when the first communications unit is housed by the housing; and the first electromagnetic wave absorbing member and the second electromagnetic wave absorbing member combine to cover the first communications unit and the second communications unit when the first communications unit is housed in the housing.

2. The wireless communications apparatus according to claim 1, wherein the portion of the recording medium has a predetermined thickness in the direction facing the second communications unit when housed in the housing, and the housing has a shape that avoids housing more than a predetermined number of recording mediums.

3. The wireless communications apparatus according to claim 1, comprising a third electromagnetic wave absorbing member that faces a face of the first communications unit housed in the housing that does not face the second communications unit.

4. A processing apparatus, comprising:

a second communications unit that uses electromagnetic waves to perform wireless communications with an article having a first communications unit and a display, the first communications unit storing information;

a write unit configured to write image data to the display;

a housing that houses a portion of the article, the portion including the first communications unit; and a processing unit that performs predetermined processing on the article in a state housed in the housing, wherein the second communications unit is provided at a position that faces the first communications unit housed in the housing;

the housing has a first electromagnetic wave absorbing member that is an electromagnetic wave absorbing member that absorbs radiation of electromagnetic waves from inside to outside, and absorbs radiation of electromagnetic waves from the second communications unit in a direction other than towards the first communications unit of the article in a state housed in the housing;

the article has a second electromagnetic wave absorbing member, the second electromagnetic wave absorbing member disposed between the first communications unit and the display when the first communications unit is housed by the housing; and the first electromagnetic wave absorbing member and the second electromagnetic wave absorbing member combine to cover the first communications unit and the second communications unit when the first communications unit is housed in the housing.

5. A wireless communications system comprising:

a recording medium; and a wireless communications apparatus that performs wireless communications with the recording medium, wherein the recording medium includes a first communications unit and a display, the first communications unit storing information; and the wireless communications apparatus includes:

a second communications unit that uses electromagnetic waves to perform wireless communications with the recording medium;

a write unit configured to write image data to the display; and a housing that houses a portion of the recording medium that includes the first communications unit, wherein the second communications unit is provided at a position that faces the first communications unit housed in the housing;

the housing has an electromagnetic wave absorbing member that absorbs radiation of electromagnetic waves from inside to outside, and absorbs radiation of electromagnetic waves from the second communications unit in a direction other than towards the first communications unit of the recording medium in a state housed in the housing;

the recording medium has a second electromagnetic wave absorbing member, the second electromagnetic wave absorbing member disposed between the first communications unit and the display when the first communications unit is housed by the housing; and the first electromagnetic wave absorbing member and the second electromagnetic wave absorbing member combine to cover the first communications unit and the second communications unit when the first communications unit is housed in the housing.

6. The wireless communication apparatus according to claim 1, wherein the display is an electronic paper.

7. The processing apparatus according to claim 4, wherein the display is an electronic paper.

8. The wireless communication system according to claim 5, wherein the display is an electronic paper.

9. The wireless communications apparatus according to claim 1, the recording medium including a plurality of recording media, each having a predetermined thickness, and the housing configured to house at least two recording media simultaneously.

10. The processing apparatus according to claim 4, the article including a plurality of articles, each having a predetermined thickness, and the housing configured to house at least two articles simultaneously.

11. The wireless communication system according to claim 5, the recording medium including a plurality of recording media, each having a predetermined thickness, and the housing configured to house at least two recording media simultaneously.

12. The wireless communication apparatus according to claim 1, wherein the second electromagnetic wave absorbing member extends along a plane perpendicular to a plane along which the recording medium extends.

13. The processing apparatus according to claim 4, the second electromagnetic wave absorbing member extends along a plane perpendicular to a plane along which the article extends.

14. The wireless communication system according to claim 5, wherein the second electromagnetic wave absorbing member extends along a plane perpendicular to a plane along which the recording medium extends.

15. The wireless communication apparatus according to claim 1, wherein the second electromagnetic wave absorbing member extends from a first surface of the recording medium to a second and opposing surface of the recording medium.

16. The processing apparatus according to claim 4, wherein the second electromagnetic wave absorbing member extends from a first surface of the article to a second and opposing surface of the article.

17. The wireless communication system according to claim 5, wherein the second electromagnetic wave absorbing member extends from a first surface of the recording medium to a second and opposing surface of the recording medium.

* * * * *